US006489710B1

(12) United States Patent
Okita et al.

(10) Patent No.: US 6,489,710 B1
(45) Date of Patent: Dec. 3, 2002

(54) ELECTRON EMITTING APPARATUS, MANUFACTURING METHOD THEREFOR AND METHOD OF OPERATING ELECTRON EMITTING APPARATUS

(75) Inventors: Masami Okita, Tokyo (JP); Yuichi Iwase, Kanagawa (JP); Jiro Yamada, Kanagawa (JP)

(73) Assignee: Sony Corporation (JP)

( * ) Notice: Subject to any disclaimer, the term of this patent is extended or adjusted under 35 U.S.C. 154(b) by 0 days.

(21) Appl. No.: 09/231,629

(22) Filed: Jan. 15, 1999

(30) Foreign Application Priority Data

Jan. 16, 1998 (JP) ..... 10-007014
Jan. 21, 1998 (JP) ..... 10-009814

(51) Int. Cl.[7] ..... H01J 1/02
(52) U.S. Cl. ..... 313/309; 313/336; 313/351
(58) Field of Search ..... 313/309, 310, 313/336, 351, 495, 422; 315/169.3; 257/10

(56) References Cited

U.S. PATENT DOCUMENTS

| | | | | |
|---|---|---|---|---|
| 4,065,780 A | * | 12/1977 | Ballantyne | 257/753 |
| 5,012,153 A | * | 4/1991 | Atkinson et al. | 313/309 |
| 5,148,078 A | * | 9/1992 | Kane | 313/307 |
| 5,214,347 A | | 5/1993 | Gray | |
| 5,408,161 A | * | 4/1995 | Kishino et al. | 313/495 |
| 5,532,544 A | * | 7/1996 | Yoshioka et al. | 313/310 |
| 5,679,960 A | * | 10/1997 | Akama | 313/309 |
| 5,850,120 A | * | 12/1998 | Okamoto | 313/336 |
| 5,965,971 A | * | 10/1999 | Karpov | 313/309 |

FOREIGN PATENT DOCUMENTS

| | | |
|---|---|---|
| EP | 0 501 785 A2 | 9/1992 |
| EP | 0 513 777 A2 | 11/1992 |
| EP | 0 535 953 A2 | 4/1993 |
| EP | 0 739 022 A2 | 10/1996 |
| EP | 0 871 195 A1 | 10/1998 |
| WO | WO 98/25287 | 6/1998 |

OTHER PUBLICATIONS

Akinwande A. I., et al: "Nanometer Scale Thin–Film–Edge Emitter Devices with High Current Density Characteristics" Dec. 13, 1992, International Electron Devices Meeting 1992, San Francisco, Dec. 13–16, 1992 (pp. 367–370), Institute of Electrical and Electronics Engineers XP000687449.

* cited by examiner

*Primary Examiner*—Vip Patel
*Assistant Examiner*—Joseph Williams
(74) *Attorney, Agent, or Firm*—Rader, Fishman & Grauer PLLC; Ronald P. Kananen, Esq.

(57) ABSTRACT

An electron emitting apparatus having excellent mechanical strength and capable of satisfactorily emitting electrons even if a high electric field is applied and a manufacturing method therefor are disclosed. The electron emitting apparatus according to the present invention incorporates a first gate electrode formed on a substrate, a cathode formed on the first gate electrode through a first insulating layer and having a projection projecting over the first insulating layer and a second gate electrode formed on the cathode through a second insulating layer. The electron emitting apparatus has the cathode structured such that the projection has an inclined surface, the thickness of which is reduced toward the leading end.

28 Claims, 12 Drawing Sheets

ELECTRON EMITTING APPARATUS, MANUFACTURING METHOD THEREFOR AND METHOD OF OPERATING ELECTRON EMITTING APPARATUS

BACKGROUND OF THE INVENTION

1. Field of the Invention

The present invention relates to an electron emitting apparatus for emitting field electrons from a cathode thereof, a manufacturing method therefor and a method of operating the electron emitting apparatus. More particularly, the present invention relates to a flat electron emitting apparatus having a cathode formed into a flat shape, a manufacturing method therefor and a method of operating the flat electron emitting apparatus.

2. Related Background Art

In recent years, display units have been researched and developed such that the thickness of the display unit is attempted to be reduced. In the foregoing circumstance, a field emission display (hereinafter abbreviated to "FED") incorporating so-called electron emitting apparatuses has attracted attention.

As shown in FIG. 1, the FED has portions each of which corresponds to one pixel, the portion including a spint electron emitting apparatus 100 and a fluorescent surface 101 formed opposite to the spint electron emitting apparatus 100. A multiplicity of the foregoing pixels are formed into a matrix configuration so that a display unit is constituted.

In the portion corresponding to one pixel, the electron emitting apparatus 100 incorporates a cathode 103 formed on a cathode panel 102; a gate electrode 105 laminated on the cathode 103 through an insulating layer 104; and electron emitting portions 107 each of which is formed in each of a plurality of openings 106 formed in the gate electrode 105 and the insulating layer 104. The FED has the fluorescent surface 101 formed opposite to the electron emitting apparatus 100. The fluorescent surface 101 is composed of a front panel 108, an anode 109 and a fluorescent member 110 formed on the front panel 108. Moreover, the FED is structured such that predetermined voltages are applied to each of the cathode 103, the gate electrode 105 and the anode 109, respectively.

Each of the electron emitting portions 107 of the FED is formed into a cone-like shape realized by finely machining a material, such as W, Mo or Ni. The leading end of the electron emitting portion 107 is disposed apart from the gate electrode 105 for a predetermined distance. The electron emitting apparatus 100 is structured such that electrons are emitted from the leading ends of the electron emitting portions 107. The electron emitting apparatus 10 has a multiplicity of the electron emitting portions 107.

In the FED structured as described above, a predetermined electric field is generated between the cathode 103 and the gate electrode 105. As a result, electrons are emitted from the leading ends of the electron emitting portions 107. Emitted electrons collide with the fluorescent member 110 formed on the anode 109. As a result, the fluorescent member 110 is excited to emit light. When the quantity of electrons which are emitted from the electron emitting portions 107 of the FED corresponding to the pixels is adjusted, a required image can be displayed on the display unit.

When the spint electron emitting apparatus is manufactured, the openings 106 are formed such that the diameter of each opening 106 is about 1 mm. Then, the electron emitting portions are perpendicularly evaporated in the surfaces of the openings 106. Specifically, a separation layer is formed on the gate electrode 105 after the openings 106 have been formed. Then, a metal film or the like is formed. As a result, the metal film is formed on the gate electrode 105 and the bottom surfaces of the openings 106. Then, the film forming operation is continued to grow the metal film so that the cone-line electron emitting portions 107 are formed. Then, the metal film formed on the gate electrode 105 is, together with the separation layer, removed.

However, the cone-like electron emitting portions of the spint type electron emitting apparatus cannot easily be formed. Thus, there arises a problem in that a stable electron emitting characteristic cannot be realized. The reason for this lies in that the electron emitting characteristic of the spint electron emitting apparatus considerably depends on the distance between the leading end of each of the electron emitting portions and the gate electrode. Therefore, the electron emitting portions cannot reliably be formed.

When the electron emitting portions are formed, the process for forming the metal film on the gate electrode having a large area and removal of the metal film and the separation layer from the same must uniformly be performed. If the metal film cannot uniformly be formed or if the metal film and the separation layer cannot uniformly be removed, electrons cannot easily be generated from the electron emitting portions by dint of the electric field generated from the gate electrode.

When electron emitting portions are formed to correspond to a large screen, satisfactory perpendicularity cannot be realized in a film forming direction over the screen. Therefore, uniform electron emitting portions cannot easily be formed on the overall surface of the screen. What is worse, contamination sometimes occur when the metal film and the separation film are removed. Thus, there arises a problem in that satisfactory manufacturing yield cannot be obtained.

To overcome the problems experienced with the spint electron emitting apparatus, a flat electron emitting apparatus has been suggested which has a structure that a high electric field is applied to the edge of a metal electrode so as to emit field electrons.

The flat electron emitting apparatus has a structure that an emitter electrode formed into a plate-like shape is held between a pair of gate electrodes through insulating layers. Thus, an electric field generated between a pair of gate electrodes and an emitter electrode causes electrons to be emitted from the emitter electrode.

The structure of the flat electron emitting apparatus permits the emitter electrode for emitting electrons to be formed into the plate-like shape. Therefore, the flat electron emitting apparatus can easily be manufactured as compared with the above-mentioned spint electron emitting apparatus.

Also the flat electron emitting apparatus must enlarge the electric field which is generated between the emitter electrode and the pair of the gate electrodes in order to improve the electron emitting characteristic. To enlarge the electric field, the emitter electrode must furthermore be fined so as to furthermore reduce the curvature radius of the leading end of the emitter electrode.

However, if the emitter electrode of the flat electron emitting apparatus is simply fined, the mechanical strength of the emitter electrode decreases considerably. Therefore, a great electric field cannot be generated. If a great electric field is applied to the fined emitter electrode, the emitter electrode is sometimes broken. Thus, the foregoing fine emitter electrode cannot be used in a high electric field.

Hitherto, the curvature radius of the leading end of the emitter electrode can be reduced during a process for manufacturing the flat electron emitting apparatus only when exposing, developing and etching conditions for the photoresist are delicately controlled. Therefore, the conventional method cannot easily form an emitter electrode of the type having satisfactory mechanical strength and provided with the leading end having a small curvature radius.

What is worse, the flat electron emitting apparatus suffers from a poor quantity of electrons which reach the anode as compared with the spint electron emitting apparatus. Therefore, the flat electron emitting apparatus cannot cause the fluorescent member disposed on the anode to satisfactorily emit light.

SUMMARY OF THE INVENTION

Accordingly an object of the present invention is to provide an electron emitting apparatus and a manufacturing method therefor which is capable of overcoming the problems experienced with the conventional electron emitting apparatus, which exhibits satisfactory mechanical strength and which is able to satisfactorily emit electrons.

Another object of the present invention is to provide a method of operating the electron emitting apparatus such that electrons generated by the electron emitting apparatus can efficiently reach the anode.

To achieve the above-mentioned object, according to an aspect of the present invention, there is provided an electron emitting apparatus comprising: a first gate electrode formed on a substrate; a cathode formed on the first gate electrode through a first insulating layer and having a projection projecting over the first insulating layer; and a second gate electrode formed on the cathode through the second insulating layer, wherein the cathode has a structure that the projection is provided with an inclined surface having a thickness which is reduced toward the leading end of the projection.

The electron emitting apparatus according to the present invention is structured as described above so that an electric field is generated among the first gate electrode, the second gate electrode and the cathode. The electric field causes electrons to be emitted from the leading end of the cathode. The electron emitting apparatus according to the present invention has the inclined surface formed such that the thickness of the projection of the cathode is reduced toward the leading end of the projection. Thus, the curvature radius of the leading end of the cathode is reduced. That is, the portion of the cathode adjacent to the first and second insulating layers has a large thickness as compared with that of the leading end. Therefore, the electron emitting apparatus enables the leading end of the cathode to have an excellent field electron emitting characteristic. Moreover, the dynamic strength of the cathode adjacent to the first and second insulating layers can be increased.

To overcome the above-mentioned problem experienced with the conventional structure, according to another aspect of the present invention, there is provided a method of manufacturing an electron emitting apparatus comprising the steps of: forming, on a substrate, a first gate electrode layer, a first insulating film, a cathode layer, a second insulating film and a second gate electrode layer in this sequential order; forming a first opening in a predetermined region of the second gate electrode layer and causing the second insulating film to be exposed through the first opening; isotropically etching the second insulating film exposed through the first opening to expose the cathode layer through an opening having a size larger than the size of the first opening; anisotropically etching the cathode layer to form a second opening and causing the first insulating film to be exposed through the second opening; and isotropically etching the first insulating layer exposed through the second opening to cause the first gate electrode layer to be exposed, wherein the step for forming the second opening is performed such that the cathode layer is anisotropically etched so that an inclined surface having a thickness which is reduced to an end of the opening is formed.

The method of manufacturing the electron emitting apparatus structured as described above is performed such that the cathode layer is exposed such that the size of the opening is made to be larger than the size of the first opening. In this state, anisotropic etching is performed so that the second opening is formed. That is, the foregoing method is performed such that the region of the exposed cathode adjacent to the second insulating layer is covered with the second insulating film and the first gate electrode layer from an upper position. Therefore, anisotropic etching for forming the second opening is performed such that the rate at which the exposed cathode is etched is reduced in a direction toward the second insulating layer. Therefore, the foregoing method is able to easily form the second opening having the inclined surface, the thickness of which is reduced toward the end of the second opening.

To achieve the above-mentioned object, according to another aspect of the present invention, there is provided a method of manufacturing an electron emitting apparatus comprising the steps of: forming, on a substrate, a first gate electrode layer, a first insulating film, a cathode layer, a second insulating film and a second gate electrode layer in this sequential order; forming a resist film having an opening corresponding to a predetermined region of the second gate electrode layer; anisotropically etching the resist film and the second gate electrode layer exposed through the opening to form a first opening so as to cause the second insulating film to be exposed through the first opening; isotropically etching the second insulating film exposed through the first opening to expose the cathode layer through an opening having a size which is larger than the size of the first opening; anisotropically etching the exposed cathode layer to form a second opening and causing the first insulating film to be exposed through the second opening; and isotropically etching the first insulating layer exposed through the second opening so as to expose the first gate electrode layer, wherein the step for forming the first opening is performed such that an inclined surface having a thickness which is reduced toward an end of the first opening is formed, and the step for forming the second opening is performed such that the cathode layer is anisotropically etched together with an end of the first opening so that the inclined surface provided for the first opening is transferred so that an inclined surface having a thickness which is reduced toward an end of the first opening is formed.

The method of manufacturing an electron emitting apparatus according to the present invention is structured as described above such that the first opening having the inclined surface, the thickness of which is reduced toward the end of the first opening, is formed. Then, the cathode layer is anisotropically etched together with the inclined surface of the first opening in a state in which the cathode layer is exposed in such a manner that the size of the opening is larger than the size of the first opening. Thus, the second opening is formed. Therefore, the foregoing method is performed such that the anisotropic etching operation for the purpose of forming the second opening results in the etching rate of a region of the exposed cathode layer adjacent to the second insulating layer being reduced owing to an influence of the inclined surface provided for the first opening. As a result, the second opening having the inclined surface having the thickness which is reduced toward the end of the second opening can be formed by the above-mentioned method.

To achieve the above-mentioned object, according to another aspect of the present invention, there is provided a method of operating an electron emitting apparatus such that an electron emitting apparatus having a first gate electrode, a cathode formed on the first gate electrode through a first insulating layer and a second gate electrode formed on the cathode through a second insulating layer which are formed on a substrate is operated, the method of operating an electron emitting apparatus comprising the step of: applying voltages to satisfy a relationship as V2>V1>Vc on an assumption that voltage which is applied to the first gate electrode is V1, voltage which is applied to the cathode is Vc and voltage which is applied to the second gate electrode is V2.

The method of operating the electron emitting apparatus according to the present invention and structured as described above is performed such that the voltage which is positive with respect to the cathode is applied to the first and second gate electrodes. Therefore, an electric field is generated among the first gate electrode, the second gate electrode and the cathode. Since the electric field is applied to the cathode, the cathode emits electrons. At this time, a voltage higher than the voltage which is applied between the first gate electrode and the cathode is applied between the second gate electrode and the cathode. Therefore, the electric field which is generated from the first gate electrode and the second gate electrode causes electrons emitted from the cathode to move to the second gate electrode. Therefore, the above-mentioned method enables electron generated by the cathode to be extracted in a direction of the second gate electrode.

Other objects, features and advantages of the invention will be evident from the following detailed description of the preferred embodiments described in conjunction with the attached drawings.

DESCRIPTION OF THE PREFERRED EMBODIMENTS

Embodiments of an electron emitting apparatus, a manufacturing method therefor and a manufacturing method therefor according to the present invention will now be described with reference to the drawings.

Figure 1:
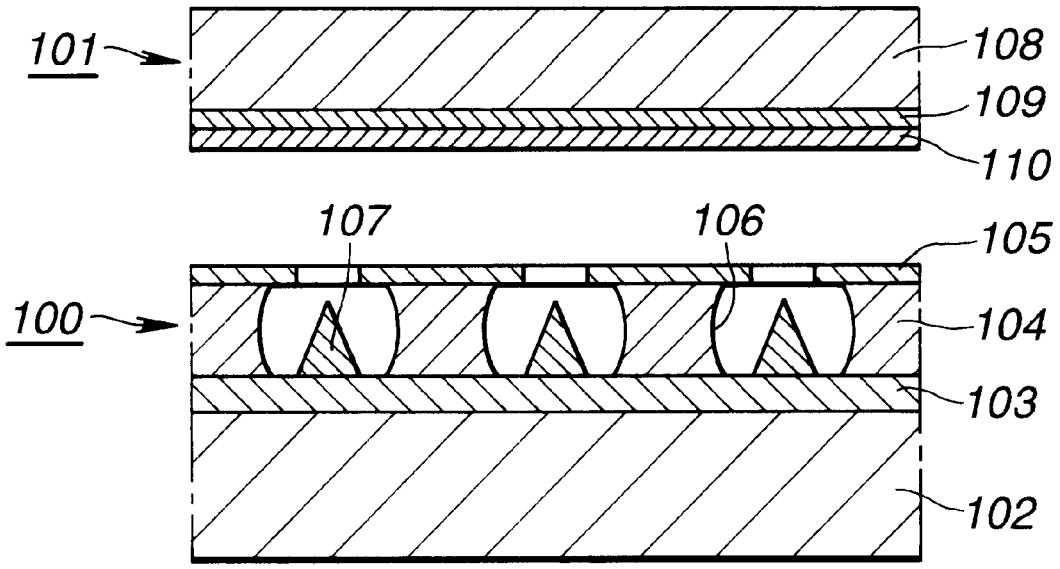
FIG. 1 is a cross sectional view showing an essential portion of a conventional electron emitting apparatus.
Figure 2:
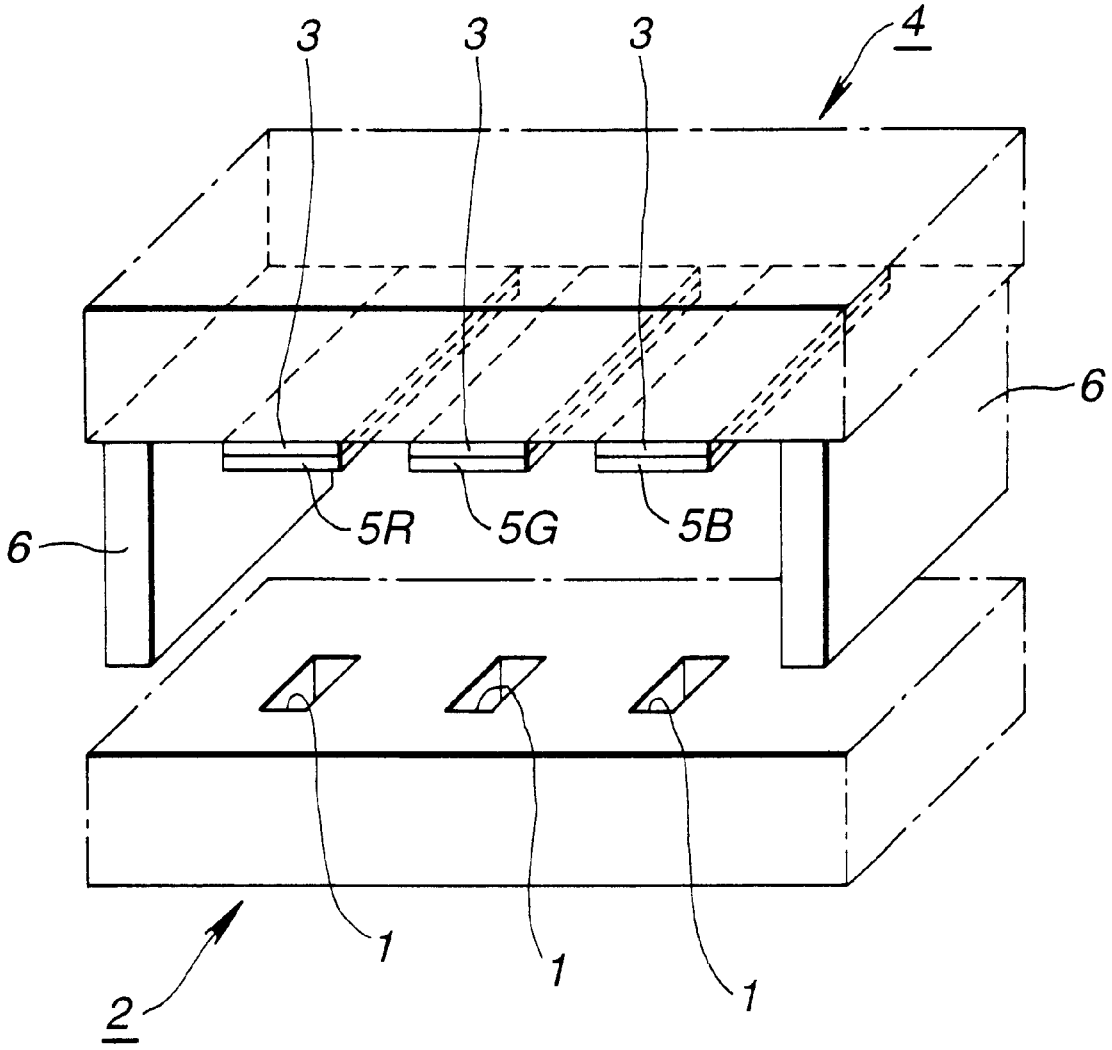
FIG. 2 is a schematic perspective view showing the structure of a FED incorporating an electron emitting apparatus according to the present invention.

As schematically shown in FIG. 2, the electron emitting apparatus according to this embodiment is applied to a so-called FED (Field Emission Display). The FED incorporates a back plate 2 having electron emitting apparatuses 1 arranged to emit field electrons and formed in a matrix configuration. Moreover, the FED incorporates a face plate 4 disposed opposite to the back plate 2 and having anodes 3 formed into a stripe pattern. Moreover, the FED has a high vacuum portion between the back plate 2 and the face plate 4.

The FED has a structure that the face plate 4 has red fluorescent members 5R formed on predetermined anodes 3 and arranged to emit red light. Green fluorescent member 5G for emitting green light are formed on the adjacent anodes 3. In addition, blue fluorescent members 5B for emitting blue light are formed on the anodes 3 adjacent to the anodes 3 having the green fluorescent member 5G. That is, the face plate 4 has the red fluorescent members 5R, green fluorescent members 5G and the blue fluorescent members 5B (hereinafter called "fluorescent members 5" when the fluorescent members are collectively called) which are alternately formed. Thus, a stripe pattern is formed.

The electron emitting apparatuses 1 of the back plate 2 are disposed opposite to the fluorescent members 5 in the three colors. One pixel of the FED is composed of the fluorescent members 5 in the three colors and the electron emitting apparatuses 1 disposed opposite to the fluorescent members 5.

Moreover, the FED incorporates a plurality of pillars 6 disposed between the back plate 2 and the face plate 4. The pillars 6 maintain a predetermined distance between the back plate 2 and the face plate 4, the portion between the back plate 2 and the face plate 4 being high vacuum as described above.

Figure 3A:
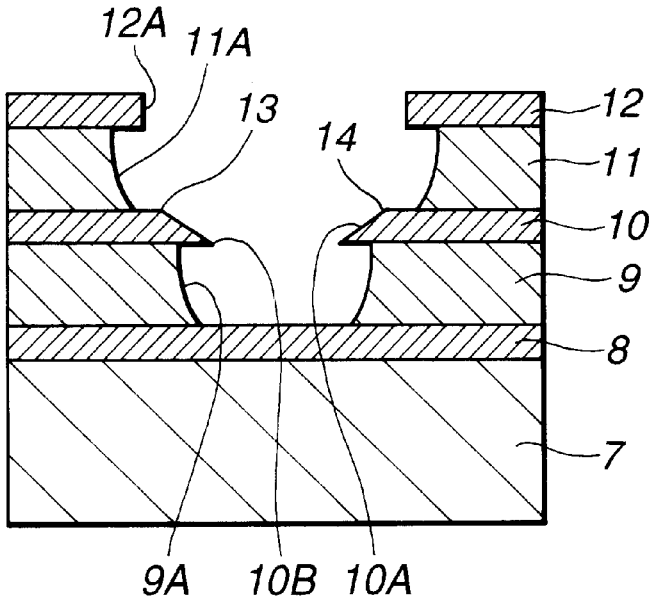
FIG. 3A is a cross sectional view showing an essential portion of the electron emitting apparatus.

As shown in FIG. 3A, each of the electron emitting apparatuses 1 of the FED incorporates an insulating substrate 7 made of glass or the like; a first gate electrode layer 8 formed on the insulating substrate 7; a cathode layer 10 laminated on the first gate electrode layer 8 through a first insulating layer 9; and a second gate electrode layer 12 laminated on the cathode layer 10 through a second insulating layer 11.

The electron emitting apparatus 1 has an opening formed in the first insulating layer 9, the cathode layer 10, the second insulating layer 11 and the second gate electrode layer 12. Electrons are emitted through the opening. The opening of each electron emitting apparatus is formed into a substantially rectangular shape. Note that the shape of the opening is not limited to the rectangular shape. The opening may be formed into a circular shape, an elliptical shape or a polygonal shape if the employed shape is free from an acute portion.

The cathode layer 10 of the electron emitting apparatus 1 has a projection 13 projecting over the first insulating layer 9 and the second insulating layer 11. That is, an opening 10A formed in the cathode layer 10 has an area smaller than that of an opening 9A formed in the first insulating layer 9 and that of an opening 11A formed in the second insulating layer 11. Moreover, the second gate electrode layer 12 of the electron emitting apparatus 1 is formed to project over the second insulating layer 11. That is, an opening 12A formed in the second gate electrode layer 12 of the electron emitting apparatus 1 is smaller than the opening 11A formed in the second insulating layer 11.

As described later, the opening 10A is provided for the cable layer 10, causing an inclined surface 14 to be provided for the projection 13. The inclined surface 14 is formed around the substantially overall inner edge of the opening 10A. Moreover, the inclined surface 14 is tapered toward the end 10B of the opening 10A. Since the cathode layer 10 has the inclined surface 14, the end 10B of the opening 10A can be finer. Moreover, the curvature radius of the end 10B of the opening 10A can be reduced.

Figure 3B:
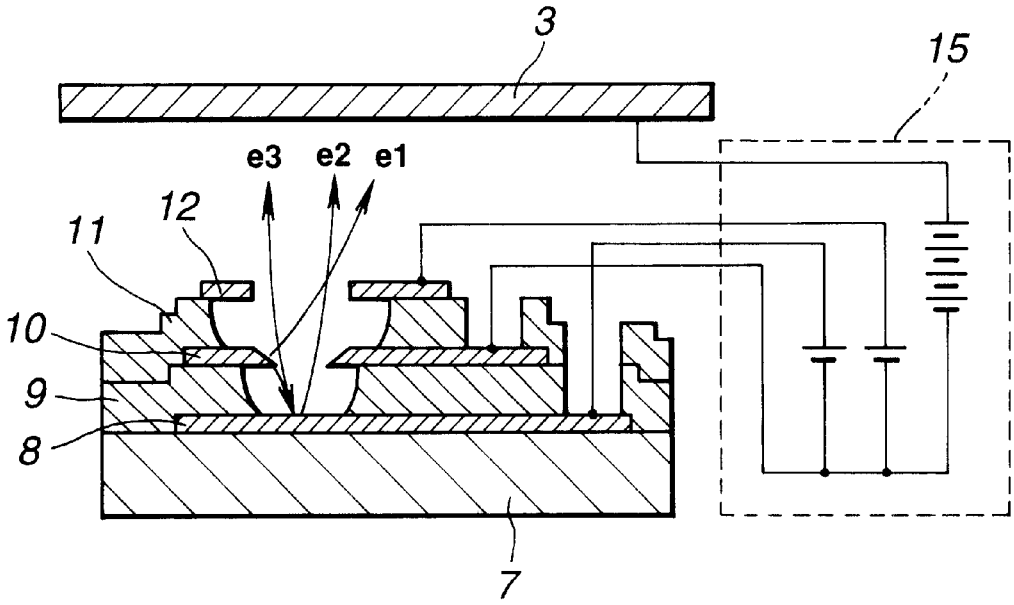
FIG. 3B is a schematic cross sectional view showing a state in which the electron emitting apparatus has been connected to a power source.

As shown in FIG. 3B, the above-mentioned electron emitting apparatus 1 is connected to a power source 15 which applies a predetermined voltage to the first gate electrode layer 8, the cathode layer 10 and the second gate electrode layer 12. Moreover, the power source 15 is connected to the anodes 3.

The electron emitting apparatus 1 structured as described above has a structure that the power source 15 applies a voltage to the first gate electrode layer 8 and the second gate electrode layer 12, the voltage being a positive voltage as compared with that of the cathode layer 10. Moreover, the FED having the electron emitting apparatus 1 has a structure that the power source 15 applies a positive voltage to the anodes 3 as compared with that of the second gate electrode layer 12.

The electron emitting apparatus 1 has the structure that a predetermined voltage is applied to the first gate electrode layer 8 and the second gate electrode layer 12 so that an electric field is generated. The electric field is applied to the end 10B of the opening 10A of the cathode layer 10. As a result, so-called field electron discharge takes place which causes electrons (e1, e2 and e3 shown in FIG. 3B) to be emitted from the end 10B of the opening 10A of the cathode layer 10.

Since the above-mentioned voltage is applied to the anodes 3 of the FED, a predetermined electric field is generated. As a result, electrons emitted as described above are accelerated by an electric field generated by dint of the voltage applied to the anodes 3. Then, accelerated electrons collide with the fluorescent members 5 formed on the anodes 3. Thus, the fluorescent members 5 are excited by the energy of collided electrons.

A portion (e1) of emitted electrons is allowed to pass through the opening 12A of the second gate electrode layer 12, and then allowed to reach the fluorescent members 5. Another portion (e2) of emitted electrons reaches the surface of the first gate electrode layer 8, and then allowed to rebound. Then, electrons are allowed to pass through the opening 12A of the second gate electrode layer 12, and then allowed to reach the fluorescent members 5. Another portion (e3) of emitted electrons reaches the surface of the first gate electrode layer 8, and then secondary discharge of electrons takes place. Then, electrons are allowed to pass through the opening 12A of the second gate electrode layer 12, and then allowed to reach the fluorescent members 5.

As described above, electrons are emitted from the end 10B of the opening 10A formed in the cathode layer 10 of the electron emitting apparatus. The thickness of the cathode layer 10 is reduced toward the end 10B of the opening 10A because the inclined surface 14 is formed. That is, the electron emitting apparatus 1 has the structure that the end 10B of the opening 10A for emitting electrons has a smaller curvature radius. The electron emitting apparatus 1 has the structure that the thickness of the end 10B of the opening 10A for emitting electrons is reduced considerably and the curvature radius of the end 10B of the opening 10A is reduced satisfactorily. Therefore, an electric field generated by the first gate electrode layer 8 and the second gate electrode layer 12 efficiently acts on the end 10B of the opening 10A.

As a result, the quantity of electron which can be emitted from the electron emitting apparatus 1 can be enlarged even if the same voltage, which is applied to the conventional flat electron emitting apparatus, is applied. That is, even if the operation voltage which is applied to the first gate electrode layer 8 and the second gate electrode layer 12 is lowered, the electron emitting apparatus 1 according to this embodiment is able to emit electron in a large quantity.

The electron emitting apparatus 1 has the structure that the projection 13 has the inclined surface 14 in order to reduce the curvature radius of the end 10B of the opening 10A. Therefore, the electron emitting apparatus 1 has a structure that a portion of the projection 13 opposite to the end 10B of the opening 10A has a large width. That is, only the end 10B of the opening 10A of the cathode layer 10 is tapered. On the other hand, the other portion has a predetermined thickness. As a result, the cathode layer 10 of the electron emitting apparatus 1 has great mechanical strength.

When a great electric field is generated by the first gate electrode layer 8 and the second gate electrode layer 12 of the electron emitting apparatus 1, dynamic force acts on the projection 13 of the cathode layer 10. However, breakage of the cathode layer 10 of the electron emitting apparatus 1 owning to the dynamic force can be prevented. As a result, the electron emitting apparatus 1 can be operated at a voltage which generates a large electric field.

A method of manufacturing the electron emitting apparatus 1 according to the present invention will now be described.

Figure 4:
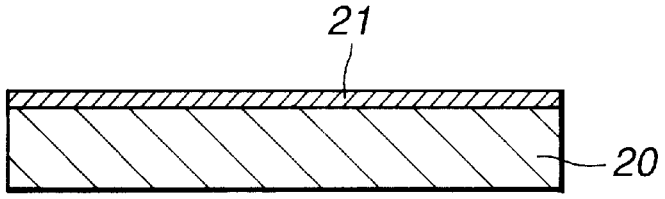
FIG. 4 is a cross sectional view showing an essential portion of a method of manufacturing the electron emitting apparatus according to the present invention in a state in which a first conductive layer has been formed on an insulating substrate.

When the electron emitting apparatus 1 is manufactured, the first conductive layer 21 made of a conductive material is formed to have a predetermined thickness on the insulating substrate 20 made of glass or the like, as shown in FIG. 4. At this time, it is preferable that the first conductive layer 21 is formed by a thin film forming method, such as sputtering, vacuum evaporation or CVD.

Figure 5:
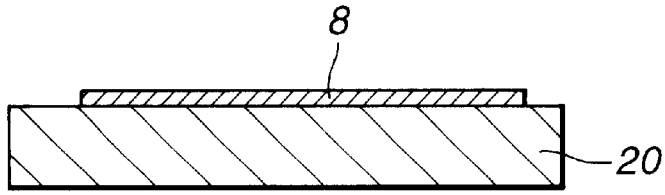
FIG. 5 is a cross sectional view showing an essential portion of the method of manufacturing the electron emitting apparatus according to the present invention in a state in which a first gate electrode layer has been formed on the insulating substrate.

Then, as shown in FIG. 5, the first conductive layer 21 is patterned to have a predetermined shape by a method, such as etching. Thus, the first gate electrode layer 8 is formed. At this time, a known method, such as photolithography or etching, is employed to form the first gate electrode layer 8. Thus, the first gate electrode layer 8 having a predetermined shape is formed on the insulating substrate 20.

Figure 6:
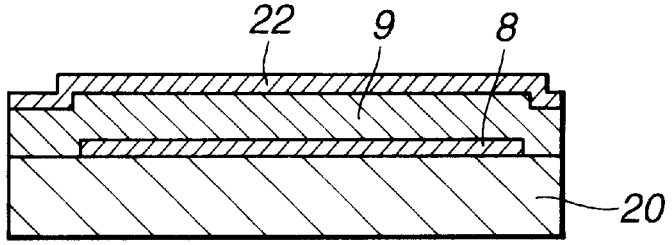
FIG. 6 is a cross sectional view showing an essential portion of the method of manufacturing the electron emitting apparatus according to the present invention in a state in which a first insulating and a second conductive layer have been formed.

Then, as shown in FIG. 6, the above-mentioned method is employed so that the first insulating layer 9 and the second conductive layer 22 are formed on the overall surfaces of the insulating substrate 20 and the first gate electrode layer 8. The first insulating layer 9 is a layer for insulating the first gate electrode layer 8 and the second conductive layer 22 from each other. The first insulating layer 9 is made of an insulating material, such as $SiO_2$. The second conductive layer 22 is a layer which will be formed into the cathode layer 10. The second conductive layer 22 is made of a conductive material, such as W, Mo or Ni, or a semiconductor.

Figure 7:
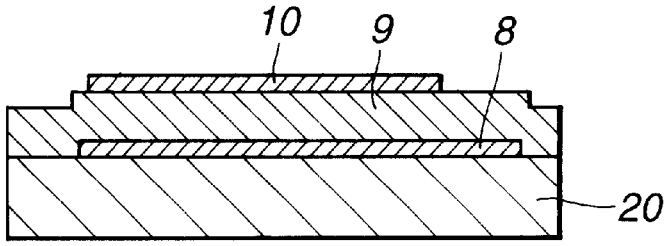
FIG. 7 is a cross sectional view showing an essential portion of the method of manufacturing the electron emitting apparatus according to the present invention in a state in which a cathode layer has been formed.

Then, as shown in FIG. 7, the second conductive layer 22 is patterned by the above-mentioned method so that the cathode layer 10 is formed. At this time, the cathode layer 10 is formed on the substantially overall region above the first gate electrode layer 8. Since electric conduction between the outside and the first gate electrode layer 8 must be realized in a process to be described later, the cathode layer 10 is not formed in a portion above a predetermined region of the first gate electrode layer 8.

Figure 8:
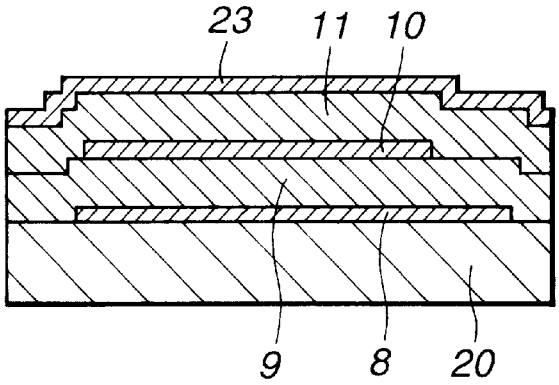
FIG. 8 is a cross sectional view showing an essential portion of the method of manufacturing the electron emitting apparatus according to the present invention in a state in which a second insulating layer and a third conductive layer have been formed.

Then, as shown in FIG. 8, the second insulating layer 11 and the third conductive layer 23 are formed on the substantially overall surfaces of the first insulating layer 9 and the cathode layer 10 by the foregoing method. The second insulating layer 11 is a layer for insulating the cathode layer 10 and the third conductive layer 23 from each other. The second insulating layer 11 is made of a material similar to that for making the first insulating layer 9. The third conductive layer 23 is a layer which will be formed into the second gate electrode layer 12. The third conductive layer 23 is made of a material similar to that for making the first conductive layer 21.

Figure 9:
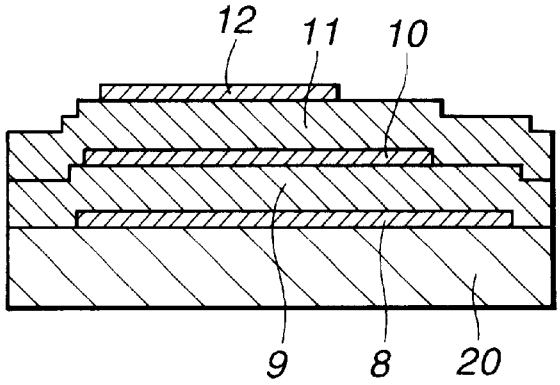
FIG. 9 is a cross sectional view showing an essential portion of the method of manufacturing the electron emitting apparatus according to the present invention in a state in which a second schematic electrode layer has been formed.

Then, as shown in FIG. 9, the third conductive layer 23 is patterned to have a predetermined shape by the foregoing method so that the second gate electrode 12 is formed. At this time, the second gate electrode layer 12 is formed on the substantially overall region above the cathode layer 10. Since the electric conduction must be realized between the outside and the cathode layer 10 in a process to be described later, the second gate electrode layer 12 is not formed in a region above a predetermined region of the cathode layer 10.

Figure 10:
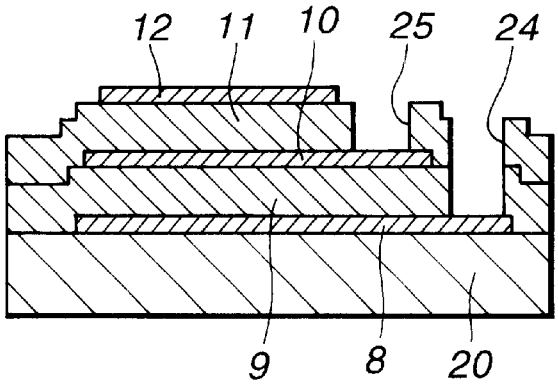
FIG. 10 is a cross sectional view showing an essential portion of the method of manufacturing the electron emitting apparatus according to the present invention in a state in which first and second connection holes have been formed.

Then, as shown in FIG. 10, a first connection hole 24 for realizing electric conduction between the first gate electrode layer 8 and the outside is formed. Moreover, a second connection hole 25 for realizing electric conduction between the cathode layer 10 and the outside is formed. The first connection hole 24 is formed by boring the first insulating layer 9 and the second insulating layer 11. Thus, the first gate electrode layer 8 is exposed to the outside. The second connection hole 25 is formed by boring the second insulating layer 11 so that the cathode layer 10 is exposed to the outside.

Figure 11:
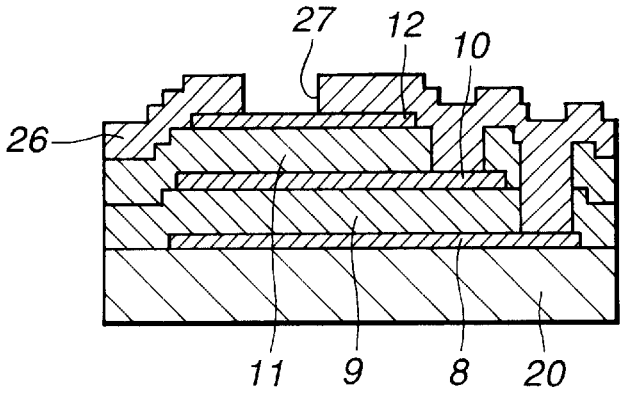
FIG. 11 is a cross sectional view showing an essential portion of the method of manufacturing the electron emitting apparatus according to the present invention in a state in which a resist film having a predetermined shape has been formed.

Then, as shown in FIG. 11, a photoresist 26 is formed to have a predetermined thickness on the second gate electrode layer 12 and the second insulating layer 11. Then, a predetermined region is exposed to light, and then developed. As a result, a resist opening 27 which reaches the second gate electrode layer 12 is formed in the photoresist 26.

Figure 12:
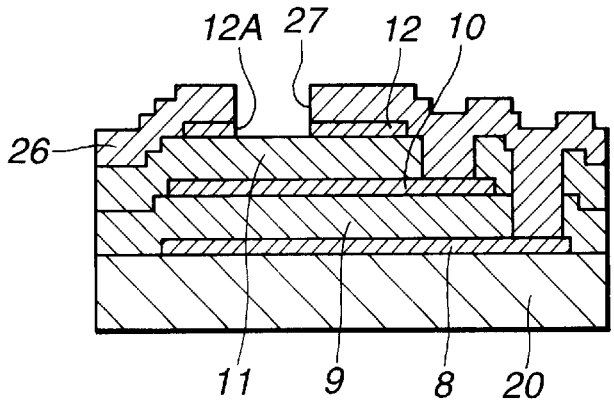
FIG. 12 is a cross sectional view showing an essential portion of the method of manufacturing the electron emitting apparatus according to the present invention in a state in which an opening has been formed in the second gate electrode layer.

Then, as shown in FIG. 12, anisotropic etching of the surface on which the photoresist 26 has been formed is performed. The anisotropic etching process may be performed by a method, such as reactive ion etching (hereinafter called "RIE"). It is preferable that the etching operation is performed under condition that sulfur hexafluoride is employed as a reaction gas when the second gate electrode layer 12 is made of tungsten (W). As a result, the opening 12A which is in parallel with the laminating direction is formed in the second gate electrode layer 12.

Figure 13:
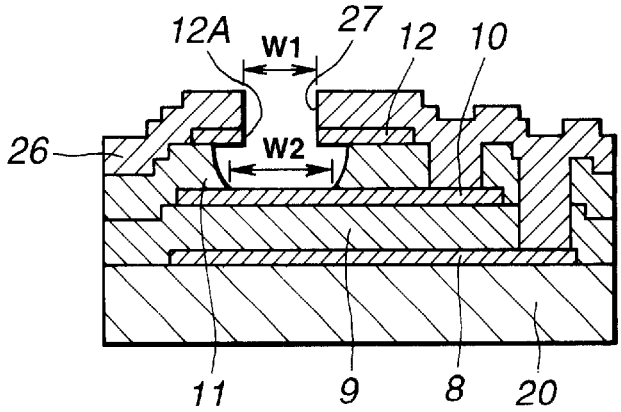
FIG. 13 is a cross sectional view showing an essential portion of the method of manufacturing the electron emitting apparatus according to the present invention in a state in which the second insulating layer has been isotropically etched.

Then, as shown in FIG. 13, isotropic etching of the surface having the opening 12A is performed. The isotropic etching may be performed by, for example, wet etching. It is preferable that the isotropic etching operation is performed under a condition that hydrofluoric acid serving as a buffer is employed as the etching solution when the second insulating layer 11 is made of silicon dioxide. Since the isotropic etching process is performed, the second insulating layer 11 is isotropically etched. Thus, the second insulating layer 11 is etched to a position more inner than the opening 12A of the second gate electrode layer 12.

In this embodiment, the isotropic etching operation is continued until the cathode layer 10 is exposed through an opening having a size larger than that of the opening 12A formed in the second gate electrode layer 12. That is, the isotropic etching operation is continued until the width for which the cathode layer 10 is exposed and which is indicated by W2 shown in FIG. 13 is larger than the width of the opening formed in the second gate electrode layer 12 and indicated by W1 shown in FIG. 13.

Figure 14:
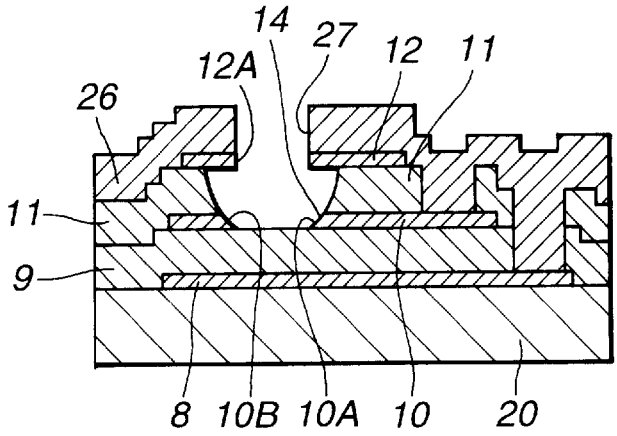
FIG. 14 is a cross sectional view showing an essential portion of the method of manufacturing the electron emitting apparatus according to the present invention in a state in which an opening has been formed in the cathode layer.

Then, as shown in FIG. 14, anisotropic etching of the exposed cathode layer 10 is performed from a position adjacent to the photoresist 26. In this case, anisotropic etching is etching having anisotropy which is in parallel with the laminating direction. The anisotropic etching is continued until the first insulating layer 9 is exposed. The anisotropic etching operation may be performed by, for example, the RIE or dry etching. Similarly to the process for anisotropically etching the second gate electrode layer 12, it is preferable that the etching operation is performed such that sulfur hexafluoride is employed as a reaction gas when the cathode layer 10 is made of tungsten.

As a result of the anisotropic etching operation, a portion of the exposed cathode layer 10 which is exposed through the opening 12A of the second gate electrode layer 12 is uniformly opened in a direction in parallel with the laminating direction. As a result of the anisotropic etching operation, a portion of the exposed cathode layer 10, above which the second gate electrode layer 12 and the second insulating layer 11 project, is opened non-uniformly. That is, the portion of the cathode layer 10 above which the back plate 2 and the like project, is etched at an etching rate which is lower than the etching rate for the region facing the upper opening. Moreover, the etching rate for the region, above which the second gate electrode layer 12 and the like project, is reduced in proportion to the distance to the boundary from the second insulating layer 11.

As described above, the method according to this embodiment has a structure that the cathode layer 10 is anisotropically etched. Thus, the opening 10A having the inclined surface 14 is formed in the cathode layer 10. That is, the method according to this embodiment causes the inclined surface 14 to be formed, the thickness of which is reduced in a direction toward the end 10B of the opening 10A.

Figure 15:
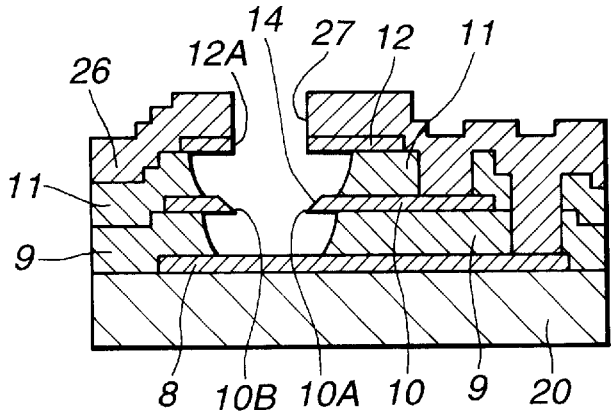
FIG. 15 is a cross sectional view showing an essential portion of the method of manufacturing the electron emitting apparatus according to the present invention in a state in which the insulating layer has been isotropically etched.

Then, as shown in FIG. 15, the surface of the cathode layer 10 in which the opening 10A has been formed is isotropically etched. The isotropic etching operation may be performed by a method, for example, wet etching. Similarly to the process for etching the second insulating layer 11, it is preferable that the etching operation is performed under a condition that hydrofluoric acid serving as a buffer is employed as the etching solution when the first insulating layer 9 is made of silicon dioxide. As a result of the isotropic etching operation, the first insulating layer 9 is isotropically etched. Thus, the second insulating layer 11 is etched to a position more inner than the opening 10A of the cathode layer 10.

In this embodiment, the isotropic etching is performed such that the inclined surface 14 is allowed to project over the first insulating layer 9 and the second insulating layer 11. Moreover, the first gate electrode layer 8 is exposed. As a result of the above-mentioned isotropic etching operation, the projection 13 is provided for the cathode layer 10.

Figure 16:
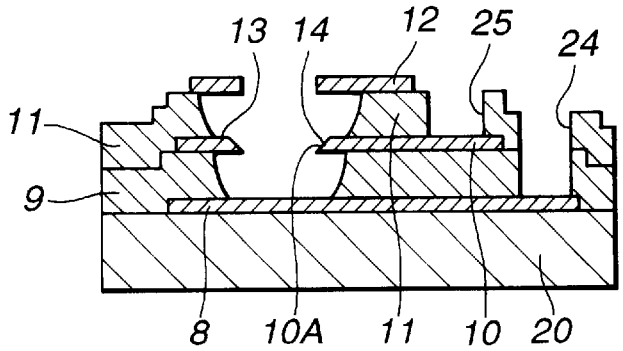
FIG. 16 is a cross sectional view showing an essential portion of the method of manufacturing the electron emitting apparatus according to the present invention in a state in which the resist film has been formed.

Then, as shown in FIG. 16, an organic solvent or the like is employed to perform a cleaning operation so that the photoresist 26 is removed. Then, a process (not shown) is performed such that the first gate electrode layer 8 and the power source are connected to each other through the first connection hole 24. Moreover, the cathode layer 10 and the power source are connected to each other through the second connection hole 25. In addition, the second gate electrode layer 12 and the power source are connected to each other in the portion exposed over the upper surface.

The method of manufacturing the electron emitting apparatus according to this embodiment has the structure that the second insulating layer 11 is isotropically etched. Therefore, the portion of the cathode layer 10 larger than the size of the opening 12A formed in the second gate electrode layer 12 can be exposed. Since the anisotropic etching is performed in the above-mentioned state, the method according to this embodiment enables the inclined surface 14 to be provided for the projection 13 of the cathode layer 10.

As described above, the method according to this embodiment is able to easily form the cathode layer 10 having the inclined surface 14 without a necessity of delicately controlling exposing and developing conditions for the photoresist and the etching conditions. Thus, the method according to this embodiment is able to easily manufacture the electron emitting apparatus having the cathode layer 10 and exhibiting an excellent field electron emitting characteristic.

According to the foregoing method, control of the thickness of the second insulating layer 11 and duration for which the second insulating layer 11 is isotropically etched enables the inclined surface 14 having a required shape to be formed. As a result, the method according to this embodiment is able to easily form the cathode layer 10 having a required field electron emitting characteristic. Therefore, the foregoing method is able to easily manufacture the electron emitting apparatus while the electric field emitting characteristic is being controlled.

The method of manufacturing the electron emitting apparatus according to the present invention is not limited to the above-mentioned method. The following method may be employed. Note that the same processes as the processes which have been described above are omitted from description. Specifically, the processes shown in FIGS. 4 to 11, which are the same as those employed in the following method, are omitted from description.

Figure 17:
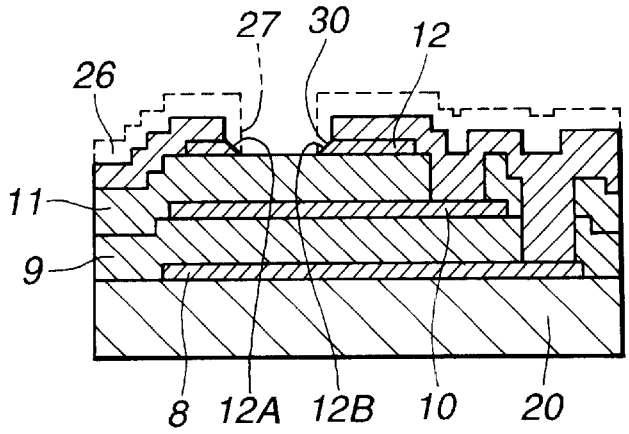
FIG. 17 is a cross sectional view showing an essential portion of the method of manufacturing the electron emitting apparatus according to the present invention in a state in which the resist film and the second gate electrode layer have been anisotropically etched.

With this method, the photoresist 26 is formed, and then the pillars 6 and the second gate electrode layer 12 are anisotropically etched, as shown in FIG. 17. The anisotropic etching operation is performed in such a manner that a portion of the photoresist 26 in a direction of the thickness of the photoresist 26 and the second gate electrode layer 12 exposed through the resist opening 27 are etched.

With this method, an edge 30 provided with an inclined surface having the thickness which is reduced toward an end 12B of an opening 12A is formed by the anisotropic etching operation. The opening 12A is formed at a position corresponding to a resist opening 27. That is, the foregoing method causes the portion corresponding to the resist opening 27 to be formed as the opening 12A. The edge 30 of the opening 12B having the inclined surface is formed in a portion in which the photoresist 26 which is removed by anisotropic etching has been formed.

The method of anisotropically etching the photoresist 26 and the second gate electrode layer 12 may be RIE. It is preferable that the foregoing etching operation is performed under a condition that a mixture gas of methane tetrafluoride and oxygen is employed as the reaction gas when the second gate electrode layer 12 is made of tungsten.

When the condition of the reaction gas for use in the RIE operation is adjusted, a predetermined region of the photoresist 26 can be removed. Moreover, the edge 30 of the opening 12B having the inclined surface can be provided for the second gate electrode layer 12 covered with the photoresist 26 which has been removed.

Figure 18:
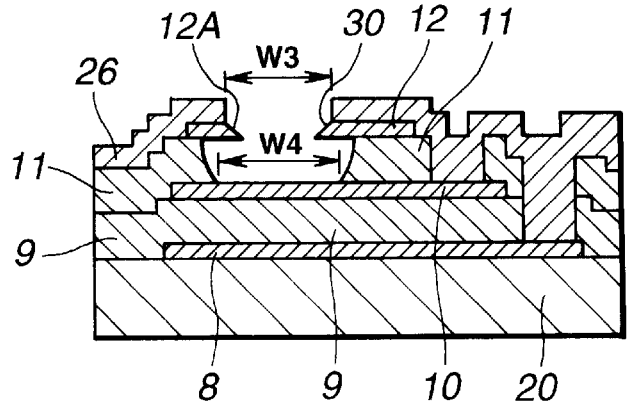
FIG. 18 is a cross sectional view showing an essential portion of the method of manufacturing the electron emitting apparatus according to the present invention in a state in which the second insulating layer has been isotropically etched.

Then, as shown in FIG. 18, the surface in which the opening 12A has been formed is isotropically etched in order to form an opening in the second insulating layer 11. The isotropic etching operation is performed similarly to the above-mentioned isotropic etching operation. Thus, the cathode layer 10 is exposed to the outside.

With this method, the isotropic etching operation is continued until the size of exposure of the cathode layer 10 indicated with W4 shown in FIG. 18 is larger than the width of the opening 12A indicated with W3 shown in FIG. 18.

Figure 19:
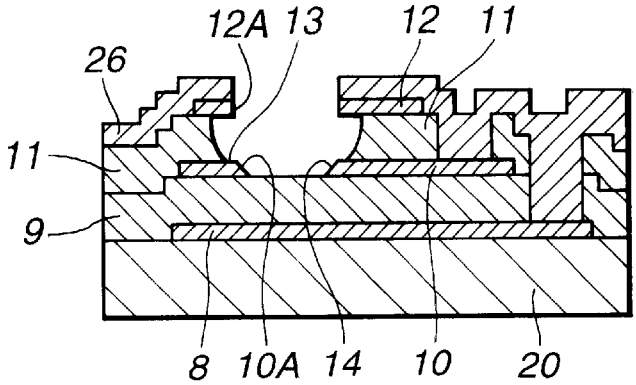
FIG. 19 is a cross sectional view showing an essential portion of the method of manufacturing the electron emitting apparatus according to the present invention in a state in which an opening has been formed in the cathode layer.

Then, as shown in FIG. 19, the edge 30 of the opening 12B formed in the second gate electrode layer 12 and the exposed cathode layer 10 are anisotropically etched. The anisotropic etching operation is continued until the edge 30 of the opening 12B formed in the second gate electrode layer 12 is completely etched. As a result of the foregoing anisotropic etching operation, an exposed portion of the exposed cathode layer 10 through the opening 12A of the second gate electrode layer 12 is uniformly bored. Thus, the opening 10A is formed. On the other hand, the foregoing method causes a portion of the exposed cathode layer 10 positioned below the edge 30 of the opening 12B of the second gate electrode layer 12 to be etched such that the shape of the inclined surface provided for the edge 30 of the opening 12B is transferred. Thus, the projection 13 having the inclined surface 14 is formed.

As a result, the foregoing method causes the projection 13 having the inclined surface 14 to be provided for the cathode layer 10. That is, the foregoing method has the structure that the anisotropic etching operation is performed such that the shape of the inclined surface 14 provided for the second gate electrode layer 12 is transferred. Thus, the inclined surface 14 is provided for the cathode layer 10.

Figure 20:
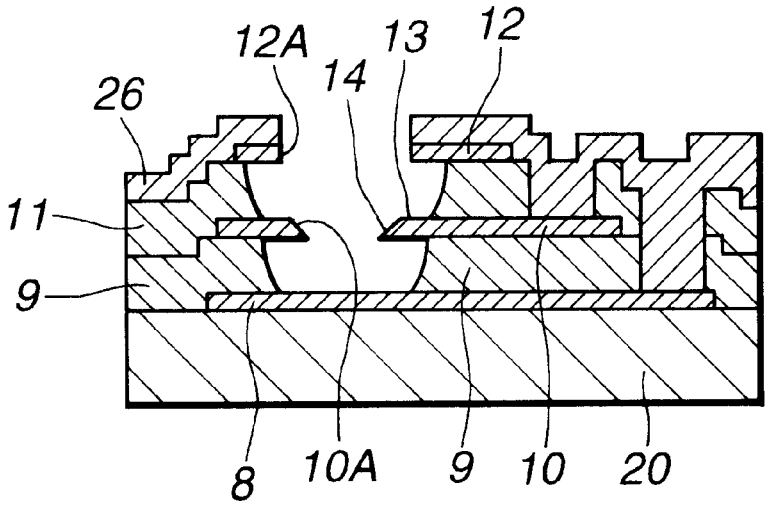
FIG. 20 is a cross sectional view showing an essential portion of the method of manufacturing the electron emitting apparatus according to the present invention in a state in which the first insulating has been isotropically etched.

Then, as shown in FIG. 20, the first insulating layer 9 exposed through the opening 10A is isotropically etched. The isotropic etching operation is continued until the first gate electrode layer 8 is exposed. Moreover, the projection 13 having the inclined surface 14 is allowed to project over the first gate electrode layer 8 and the second insulating layer 11. The isotropic etching operation is performed similarly to the above-mentioned operation.

Figure 21:
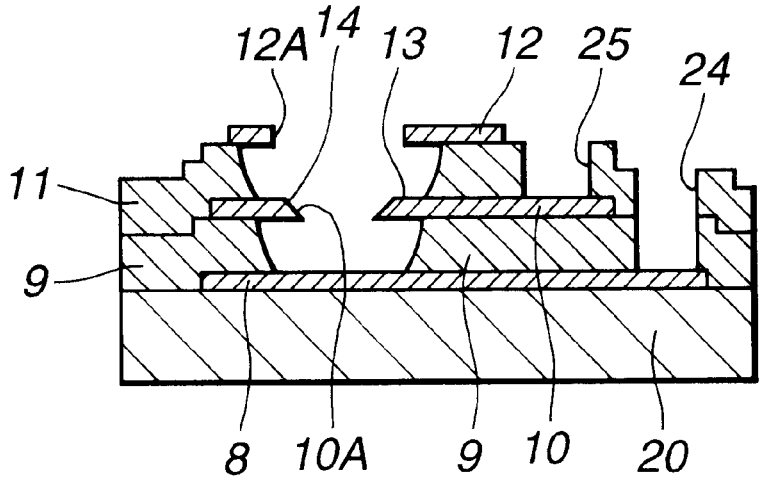
FIG. 21 is a cross sectional view showing an essential portion of the method of manufacturing the electron emitting apparatus according to the present invention in a state in which the resist film has been removed.

Then, as shown in FIG. 21, organic solvent or the like is employed to perform a cleaning process so that the photoresist 26 is removed. Then, a process (not shown) is performed such that the first gate electrode layer 8 and the power source are connected to each other through the first connection hole 24. Moreover, the cathode layer 10 and the power source are connected to each other through the second connection hole 25. In addition, the second gate electrode layer 12 and the power source are connected to each other in a portion exposed over the upper surface.

The above-mentioned method of manufacturing the electron emitting apparatus has the structure that the anisotropic etching operation for etching the photoresist 26 together with the second gate electrode layer 12 is performed. Thus, the inclined surface is provided for the edge 30 of the opening 12B of the second gate electrode layer 12. The foregoing method has the structure that the edge 30 of the opening 12B and the cathode layer 10 are simultaneously anisotropically etched. Thus, the inclined surface provided for the edge 30 of the opening 12B can be transferred. As a result, the inclined surface 14 can easily be provided for the projection 13 of the cathode layer 10.

As described above, the above-mentioned method is able to easily form the cathode layer 10 having the inclined surface 14 without a necessity of delicately controlling the exposing and developing conditions for the photoresist and the etching condition. Thus, the foregoing method is able to easily manufacture the electron emitting apparatus having the cathode layer 10 exhibiting an excellent field electron emitting characteristic.

When the reaction gas for use to anisotropically etch the photoresist 26 and the second gate electrode layer 12 is adjusted, the foregoing method is able to provide the inclined surface for the edge 30 of the opening 12B of the second gate electrode layer 12. When the reaction gas is furthermore adjusted, the inclined surface having a required shape can be formed. Therefore, the above-mentioned method is able to easily realize the shape of the inclined surface 14 of the cathode layer 10 having a required field electron emitting characteristic. As described above, the foregoing method is able to easily manufacture the electron emitting apparatus incorporating the cathode layer 10 having a required charged electron emitting characteristic.

An embodiment of the method of operating the electron emitting apparatus according to the present invention will now be described with reference to the drawings.

Figure 22:
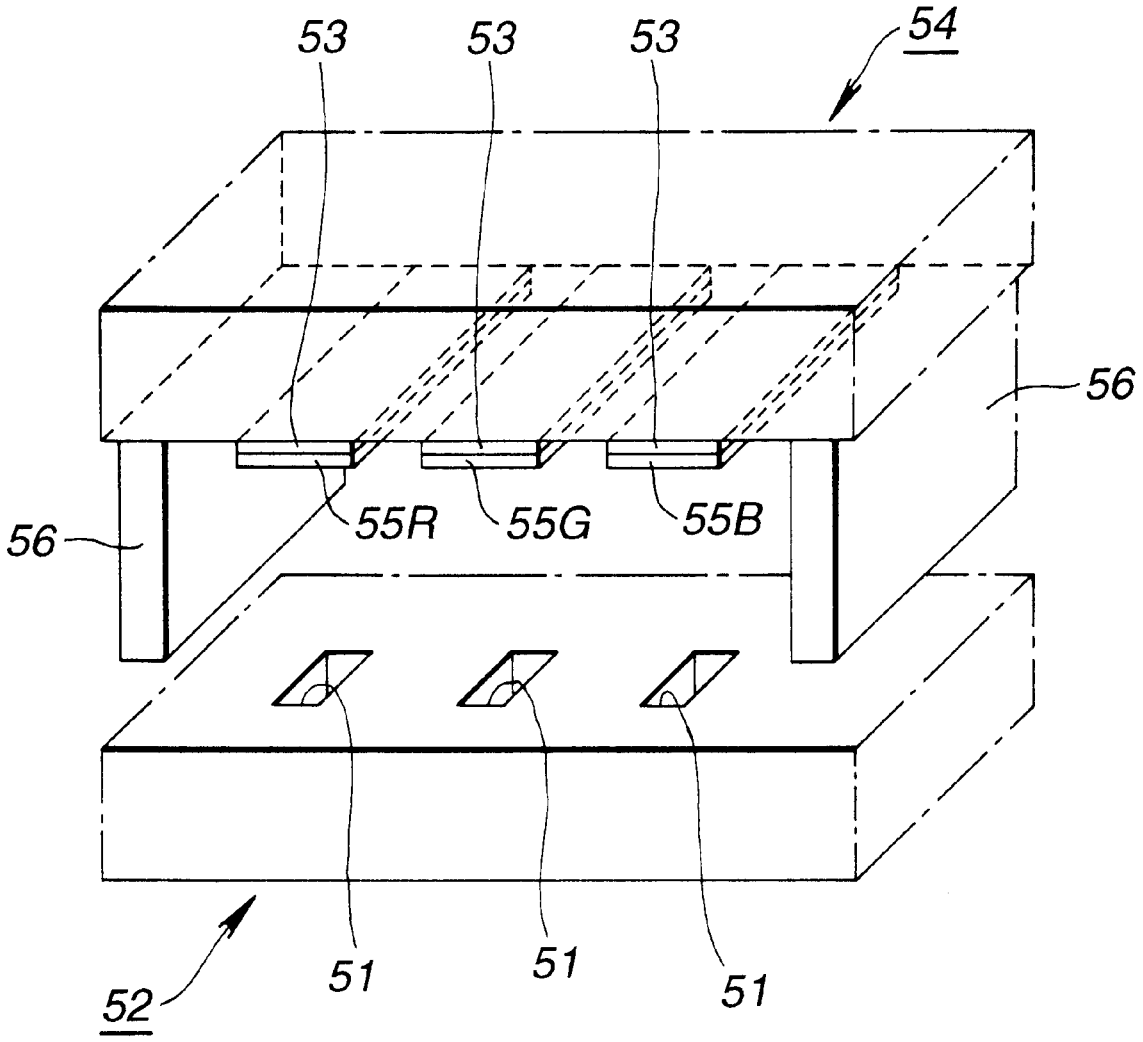
FIG. 22 is a schematic perspective view showing the structure of a FED incorporating the electron emitting apparatuses to which the operation method according to the present invention is applied.

As schematically shown in FIG. 22, the method according to this embodiment is applied when an electron emitting apparatus for use in a so-called FED (Field Emission Display) is operated. Note that the method according to this embodiment may be applied when the electron emitting apparatus structured as shown in FIG. 2 is operated.

The FED incorporates a back plate 52 having electron emitting apparatuses 51 arranged to emit field electrons and formed in a matrix configuration. Moreover, the FED incorporates a face plate 54 disposed opposite to the back plate 2 and having anodes 53 formed into a stripe pattern. Moreover, the FED has a high vacuum portion between the back plate 52 and the face plate 54.

The FED has a structure that the face plate 54 has red fluorescent members 55R formed on predetermined anodes 53 and arranged to emit red light. Green fluorescent members 55G for emitting green light are formed on the adjacent anodes 53. In addition, blue fluorescent members 55B for emitting blue light are formed on the anodes 53 adjacent to the anodes 53 having the green fluorescent members 55G. That is, the face plate 54 has the red fluorescent members 55R, green fluorescent member 55G and the blue fluorescent members 55B (hereinafter called "fluorescent members 55" when the fluorescent members are collectively called) which are alternately formed. Thus, a stripe pattern is formed.

The electron emitting apparatuses 51 of the back plate 52 are disposed opposite to the fluorescent members 55 in the three colors. One pixel of the FED is composed of the fluorescent members 55 in the three colors and the electron emitting apparatuses 51 disposed opposite to the fluorescent members 55.

Moreover, the FED incorporates a plurality of pillars 56 disposed between the back plate 52 and the face plate 54. The pillars 56 maintain a predetermined distance between the back plate 52 and the face plate 54, the portion between the back plate 52 and the face plate 54 being high vacuum as described above.

Figure 23:
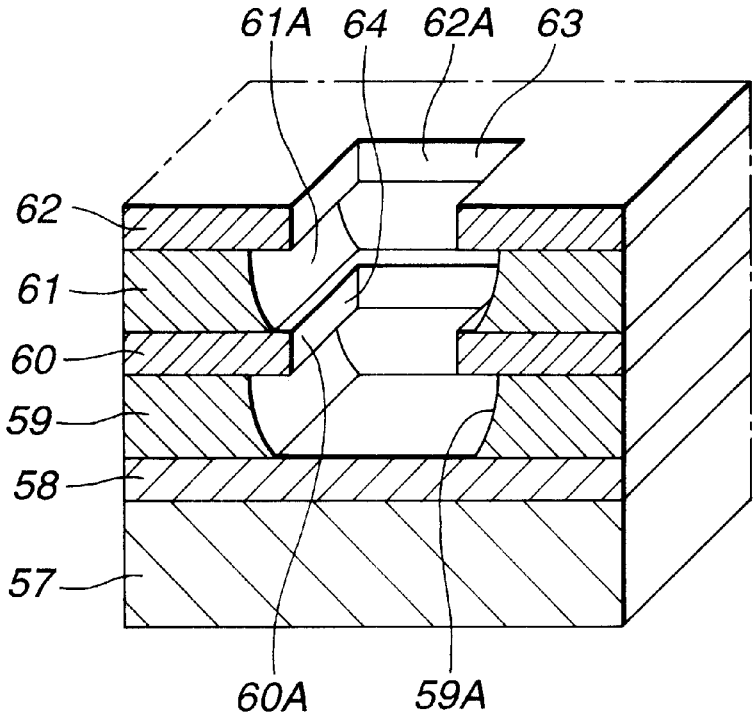
FIG. 23 is a perspective view of a cross section of an essential portion of the electron emitting apparatus.

As shown in FIG. 23, each of the electron emitting apparatuses 51 of the FED incorporates an insulating substrate 57 made of glass or the like; a first gate electrode layer 58 formed on the insulating substrate 57; a cathode layer 60 laminated on the first gate electrode layer 58 through a first insulating layer 59; and a second gate electrode layer 62 laminated on the cathode layer 60 through a second insulating layer 61. Moreover, the foregoing electron emitting apparatus has an electron emitting opening 63.

That is, the electron emitting apparatus 51 has openings formed in the first insulating layer 59, the cathode layer 60, the second insulating layer 61 and the second gate electrode layer 62. The above-mentioned openings constitute the electron emitting opening 63 Each of the openings of each electron emitting apparatus 51 is formed into a substantially rectangular shape. Note that the shape of each opening is not limited to the rectangular shape. Each opening may be formed into a circular shape, an elliptical shape or a polygonal shape if the employed shape is free from an acute portion.

In the electron emitting opening 63, the cathode layer 60 and the second gate electrode layer 62 are formed to project over the first insulating layer 59 and the second insulating layer 61. That is, in the electron emitting apparatus 51, each of an opening 60A formed in the cathode layer 60 and an opening 62A formed in the second gate electrode layer 62 has a size smaller than that of an opening 59A formed in the first insulating layer 59 and that of an opening 61A formed in the second insulating layer 61. Therefore, the electron emitting apparatus 51 has a projection 64 formed by causing the cathode layer 60 to project outwards is formed in the electron emitting opening 63.

The electron emitting apparatus 51 has the substrate 57 mainly made of an insulating material, such as glass, and having a thickness with which the substrate 57 is able to withstand the high vacuum pressure. Each of the first gate electrode layer 58 and the second gate electrode layer 62 is mainly made of a metal material, for example, W, Nb, Ta, Mo and Cr, and structured to have a thickness of about 50 nm to about 300 nm. Moreover, the cathode layer 60 is mainly made of a metal material, such as W, Nb, Ta, Mo or Cr, or a semiconductor, such as diamond and having a thickness of about 50 nm to 300 nm. Moreover, each of the first insulating layer 59 and the second insulating layer 61 is mainly made of an insulating material, such as silicon dioxide or silicon nitride, and structured to have a thickness of about 200 nm to 1000 nm.

Figure 24:
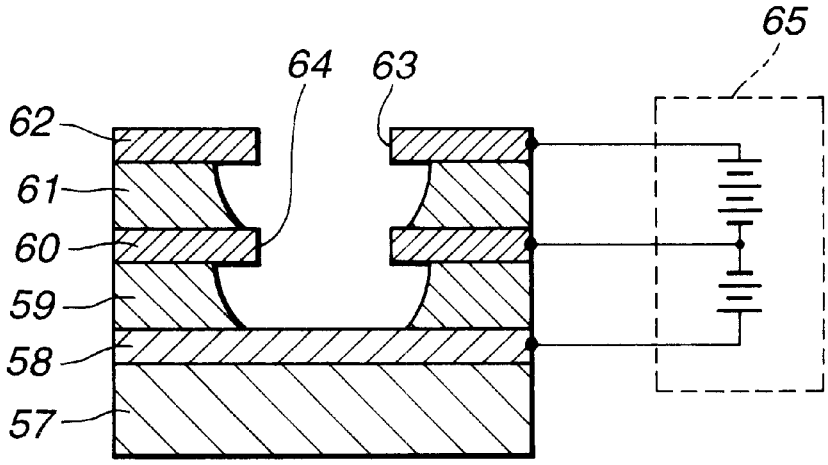
FIG. 24 is a schematic circuit diagram showing a power source for applying voltage to the electron emitting apparatus.

As shown in FIG. 24, the above-mentioned electron emitting apparatus is connected to a power source 65 which applies a predetermined voltage to the first gate electrode layer 58, the cathode layer 60 and the second gate electrode layer 62. Moreover, the power source 65 is connected to the anodes 53 (not shown).

The electron emitting apparatus 51 has a structure that the power source 65 applies a voltage between the first insulating layer 59 and the cathode layer 60 and between the second gate electrode layer 62 and the cathode layer 60. The power source 65 applies a voltage, which is positive with respect to the cathode layer 60, to the first insulating layer 59 and the second gate electrode layer 62. Moreover, the power source 65 applies a voltage, which is higher than the voltage which is applied between the first insulating layer 59 and the cathode layer 60, to a position between the second gate electrode layer 62 and the cathode layer 60.

Figure 25:
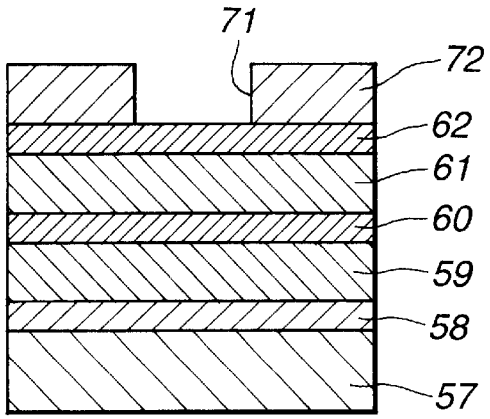
FIG. 25 is a cross sectional view showing a process for manufacturing the electron emitting apparatus.

To manufacture the electron emitting apparatus structured as described above, the first gate electrode layer 58, the first insulating layer 59, the cathode layer 60, the second insulating layer 61 and the second gate electrode layer 62 are, in this sequential order, formed on the insulating substrate 57 made of an insulating material, such as glass, as shown in FIG. 25. Then, a resist film 72 having a resist opening 71 is formed in a predetermined region on the second gate electrode layer 62.

Figure 26:
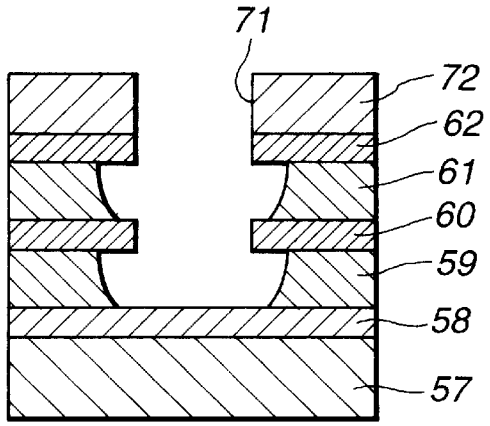
FIG. 26 is a cross sectional view showing a process for manufacturing the electron emitting apparatus.

Then, as shown in FIG. 26, an opening is formed in each of the first insulating layer 59, the cathode layer 60, the second insulating layer 61 and the second gate electrode layer 62, as described later. Specifically, the surface on which the resist film 72 has been formed is anisotropically etched by a wet etching method or the like. Thus, an opening having substantially the same shape as that of the resist opening 71 is formed in the second gate electrode layer 62. Then, an isotropic etching operation, such as wet etching, is performed from the same side so that an opening larger than the resist opening 71 is formed in the second insulating layer 61. Then, an anisotropic etching operation, such as dry etching, is performed from the same side so that an opening having substantially the same shape as that of the resist opening 71 is formed in the cathode layer 60. Then, an isotropic etching operation, such as wet etching, is performed from the same side so that an opening larger than the resist opening 71 is formed in the first insulating layer 59.

Thus, the electron emitting apparatus 51 incorporating the cathode layer 60 having the projection 64 can be manufactured. When the conditions under which the first insulating layer 59 and the second insulating layer 61 are isotropically etched are controlled, the projection distance of the projection 64 can be adjusted.

Figure 27:
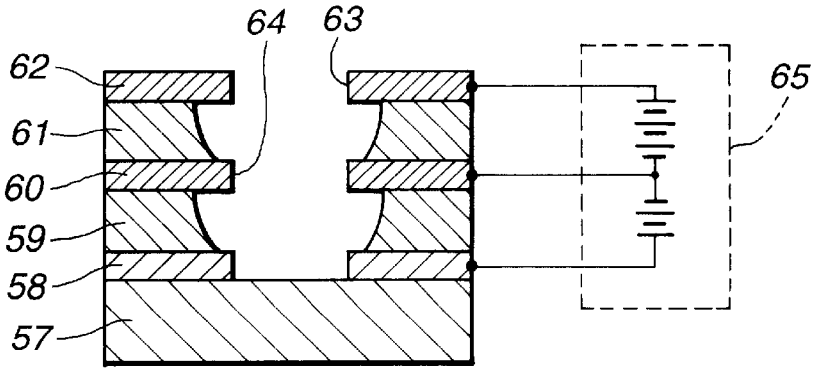
FIG. 27 is a schematic circuit diagram showing a power source for applying voltage to another electron emitting apparatus.

The electron emitting apparatus to which the method according to this embodiment is applied is not limited to the above-mentioned structure. A structure as shown in FIG. 27 may be employed in which an opening is formed in the first gate electrode layer 58. Also in the foregoing case, an electron emitting apparatus similar to the electron emitting apparatus 51 can be manufactured.

The electron emitting apparatus structured as described above is operated when each of the electrodes is applied with a predetermined voltage. Thus, electrons are emitted from the cathode layer 60. In this embodiment, the power source 65 is turned on to operate the electron emitting apparatus 51.

Assuming that voltage which is applied to the first gate electrode layer 58 is V1, voltage which is applied to the cathode layer 60 is Vc and voltage which is applied to the second gate electrode layer 62 is V2, the method of operating the electron emitting apparatus 51 is structured to satisfy the following relationship:

$$V2>V1>Vc$$

That is, the power source 65 applies a voltage, which is positive with respect to the cathode layer 60, to the first gate electrode layer 58 and the second gate electrode layer 62. Moreover, a voltage higher than the voltage, which is applied between the first insulating layer 59 and the cathode layer 60, is applied between the second gate electrode layer 62 and the cathode layer 60.

When voltages V1, V2 and Vc which satisfy the above-mentioned relationship are applied, the electron emitting apparatus 51 is brought to a state in which a predetermined electric field is generated among the first gate electrode layer 58, the second gate electrode layer 62 and the cathode layer 60. Since the foregoing electric field is applied to the projection 64 of the cathode layer 60, electrons are emitted from the projection 64.

This embodiment has a structure that the electric field is generated such that electrons generated by the projection 64 by dint of application of the voltages V1, V2 and Vc which satisfy the above-mentioned relationship are moved to the second gate electrode layer 62. Thus, a major portion of electrons generated from the projection 64 of the cathode layer 60 is moved to the second gate electrode layer 62. Thus, the method according to this embodiment is able to efficiently emit electrons from the electron emitting opening 63 to the outside of the electron emitting apparatus 51.

When the above-mentioned method was employed such that voltages were applied in such a manner that the above-mentioned relationship was satisfied and the relationship that V2/V1=about 1.3 was as well as satisfied, about 90% of electrons emitted from the cathode layer 60 were permitted to be emitted to the outside of the electron emitting apparatus 51.

It is preferable that the electron emitting apparatus is operated by the method according to this embodiment such that the voltage V1 and the voltage V2 satisfy $1.1 \leqq V2/V1 \leqq 2.5$. When the relationship V2/V1 satisfies the above-mentioned range, the method according to this embodiment is able to efficiently emit electrons to the outside of the electron emitting apparatus.

When the electron emitting apparatus is operated with voltages which satisfy the relationship V1=V2>Vc, a major portion of electrons emitted from the cathode is moved sideways. Therefore, a ratio of electrons which can be emitted to the outside of the electron emitting apparatus is about 40%. Therefore, it is preferable for the method according to this embodiment that the value of V2/V1 is larger than 1. If the value of V2/V1 is larger than 1.1, the method according to this embodiment attains a satisfactory effect.

Although efficiency of moving emitted electrons to the second gate electrode layer 62 is in proportion to the value of V2/V1, the effect cannot be improved if the value is too large. Therefore, when the method according to this embodiment is employed such that the value of V2/V1 is 2.5 or smaller, a satisfactory effect can be obtained.

The FED incorporating the electron emitting apparatuses 51 has the structure that electrons emitted to the outside of the electron emitting apparatuses 51 collide with the fluorescent members 55. Thus, the fluorescent members 55 are excited, causing the fluorescent members 55 to emit light. At this time, in the FED, a predetermined voltage is being applied from the power source 65 to the anode 53. The voltage which is applied to the anode 53 is a positive voltage as compared with the voltage V2 which is applied to the second gate electrode layer 62. As a result, a predetermined electric field is generated between the anode 53 and the electron emitting apparatus 51.

Electrons emitted to the outside of the electron emitting apparatuses 51 are accelerated by the foregoing electric field so that accelerated electrons fly toward the anode 53. Since electrons allowed to fly as described above collide with the fluorescent members 55, the fluorescent members 55 emit light.

When the electron emitting apparatuses 51 adapted to the method according to this embodiment is employed, the quantity of electrons which can be emitted from the electron emitting apparatuses 51 can be enlarged. Thus, the method according to this embodiment is able to raise the intensity of light emitted by the fluorescent members 55. As a result, the brightness of the display screen can significantly be raised.

When the electron emitting apparatus 51 is employed, the operation voltage required to generate electrons in a predetermined quantity can be lowered as compared with the conventional structure. That is, the method according to this embodiment is able to reduce power consumption for operating the electron emitting apparatus 51. As a result, the method according to this embodiment can satisfactorily be employed in a FED of a small power consumption type.

As described above, the electron emitting apparatus according to the present invention incorporates a cathode having a projection provided with the inclined surface. Thus, an electric field for emitting field electrons can efficiently be applied to the leading end of the cathode. As a result, the electron emitting apparatus is able to efficiently emit electrons. Since the electron emitting apparatus has the inclined surface provided for the projection of the cathode, the mechanical strength of the cathode can be increased. Therefore, the electron emitting apparatus has an excellent field electron emitting characteristic. Moreover, the electron emitting apparatus can stably be operated even if a great electric field is applied.

The method of manufacturing the electron emitting apparatus according to the present invention is not required to perform exposure and development such that the resist film and so forth are delicately controlled when the cathode having the projection provided with the inclined surface is formed. Therefore, the method according to the present invention is able to easily manufacture an electron emitting apparatus having an excellent field electron emitting characteristic and capable of realizing excellent mechanical strength.

The method of operating the electron emitting apparatus according to the present invention has the structure that voltages satisfying predetermined relationships are applied to the first gate electrode, the second gate electrode and the cathode to cause the cathode to emit electrons. Therefore, the method according to the present invention enables electrons emitted from the cathode to efficiently emit to the outside. As a result, the method according to the present invention enables electrons to efficiently be emitted to the outside such that only a low voltage is required.

Although the invention has been described in its preferred form with a certain degree of particularity, it is understood that the present disclosure of the preferred form can be changed in the details of construction and in the combination and arrangement of parts without departing from the spirit and the scope of the invention as hereinafter claimed.

What is claimed is:

1. A method of operating an electron emitting apparatus such that an electron emitting apparatus having a first gate electrode, a cathode formed on said first gate electrode through a first insulating layer and a second gate electrode formed on said cathode through a second insulating layer which are formed on a substrate is operated, said method of operating an electron emitting apparatus comprising the step of:

applying voltages to satisfy relationship as V2>V1>Vc on an assumption that voltage which is applied to said first gate electrode is V1, voltage which is applied to said cathode is Vc and voltage which is applied to said second gate electrode is V2.

2. A method of operating an electron emitting apparatus according to claim 1, wherein the voltage V1 which is applied to said first gate electrode and the voltage V2 which is applied to said second gate electrode has the following relationship:

$$1.1 \leqq V2/V1 \leqq 2.5$$

3. A method of operating an electron emitting apparatus according to claim 2, wherein applying said voltages V1, V2, Vc, thereby emitting electrons from an end of said cathode layer, generating a predetermined electric field, thereby exciting fluorescent members attached to said electron emitters.

4. An electron emitting apparatus comprising:

a first gate electrode layer, said first gate electrode having an emitting surface and an insulated surface, said emitting surface being a continuous surface having no opening therein, said emitting surface being coplanar with said insulated surface, said emitting surface emitting electrons.

5. An electron emitting apparatus according to claim 4, further comprising:

a first insulating layer, said first insulating layer being above said insulated surface, said emitting surface being exposed through a first insulating layer opening, said first insulating layer opening being an opening within said first insulating layer; and a second gate electrode layer, said second gate electrode layer being above said first insulating layer, said emitting surface being exposed through a second gate electrode layer opening, said second gate electrode layer opening being an opening within said second gate electrode layer.

6. An electron emitting apparatus according to claim 5, wherein said emitting surface emits electrons through said first insulating layer opening and said second gate electrode layer opening.

7. An electron emitting apparatus according to claim 6, further comprising:

an anode, said anode being above said second gate electrode layer.

8. An electron emitting apparatus according to claim 7, wherein a vacuum exists between said anode and said second gate electrode layer.

9. An electron emitting apparatus according to claim 7, wherein said anode is formed in a stripe pattern.

10. An electron emitting apparatus according to claim 7, wherein said anode is separated from said second gate electrode layer by a plurality of pillars.

11. An electron emitting apparatus according to claim 7, wherein a fluorescent member is located between said anode and said second gate electrode layer, said fluorescent member emitting light.

12. An electron emitting apparatus according to claim 11, wherein said fluorescent member is one of red fluorescent member, a green fluorescent member, and a blue fluorescent member.

13. An electron emitting apparatus according to claim 12, wherein said red fluorescent member emits red light, a green fluorescent member emits green light, and a blue fluorescent member emits blue light.

14. An electron emitting apparatus according to claim 5, further comprising:

a cathode, said cathode being formed over said first insulating layer, said second gate electrode layer being formed over said cathode, said emitting surface being exposed through a cathode opening, said cathode opening being an opening within said cathode.

15. An electron emitting apparatus according to claim 14, wherein said cathode has a cathode upper surface over a cathode lower surface, said cathode upper surface being the upper surface of said cathode, said cathode lower surface being the lower surface of said cathode, a portion of said cathode upper surface being inclined, said portion being adjacent said cathode opening.

16. An electron emitting apparatus according to claim 14, wherein said cathode opening is smaller than said first insulating layer opening.

17. An electron emitting apparatus according to claim 14, wherein said wherein said cathode opening is smaller than said second gate electrode layer opening.

18. An electron emitting apparatus according to claim 14, further comprising:

a second insulating layer, said second insulating layer being formed over said cathode, said second gate electrode layer being formed over said second insulating layer, said emitting surface being exposed through a second insulating layer opening, said second insulating layer opening being an opening within said second insulating layer.

19. An electron emitting apparatus according to claim 18, wherein said cathode opening is smaller than said first and second insulating layer openings.

20. An electron emitting apparatus according to claim 18, wherein said second insulating layer has a second connection hole formed therein, a voltage source connecting said cathode through said second connection hole.

21. An electron emitting apparatus according to claim 14, further comprising:

a first gate electrode layer voltage source, said first gate electrode layer voltage source having a voltage potential of V1 and being connected to said first gate electrode layer;

a cathode voltage source, said cathode voltage source having a voltage potential of Vc and being connected to said cathode; and a second gate electrode layer voltage source, said second gate electrode layer voltage source having a voltage potential of V2 and being connected to said second gate electrode layer.

22. An electron emitting apparatus according to claim 21, wherein V2>V1>Vc.

23. An electron emitting apparatus according to claim 21, wherein $1.1 \leqq V2/V1 \leqq 2.5$.

24. An electron emitting apparatus according to claim 5, wherein said first insulating layer has a first connection hole formed therein, a voltage source connecting said first gate electrode layer through said first connection hole.

25. An electron emitting apparatus according to claim 5, further comprising:

a substrate, said first gate electrode layer being above said substrate.

26. An electron emitting apparatus according to claim 25, wherein said substrate is made from an insulating material.

27. An electron emitting apparatus according to claim 26, wherein said insulating material comprises glass.

28. An electron emitting apparatus according to claim 5, wherein the shape of said second gate electrode layer opening is one of a rectangular, circular, elliptical, or polygonal shape.

* * * * *